US009011265B2

(12) United States Patent
Stites et al.

(10) Patent No.: US 9,011,265 B2
(45) Date of Patent: Apr. 21, 2015

(54) GOLF CLUB AND GOLF CLUB HEAD WITH A CROWN RECESSED FEATURE

(71) Applicant: NIKE, Inc., Beaverton, OR (US)

(72) Inventors: John T. Stites, Weatherford, TX (US); Robert Boyd, Flower Mound, TX (US); Raymond J. Sander, Benbrook, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/905,818

(22) Filed: May 30, 2013

(65) Prior Publication Data

US 2013/0324307 A1 Dec. 5, 2013

Related U.S. Application Data

(60) Provisional application No. 61/654,065, filed on May 31, 2012.

(51) Int. Cl.

| | |
|---|---|
| ***A63B 53/04*** | (2006.01) |
| ***A63B 49/06*** | (2006.01) |
| *A63B 59/00* | (2006.01) |

(52) U.S. Cl.

CPC ..... *A63B 53/0466* (2013.01); *A63B 2059/0011* (2013.01); *A63B 49/06* (2013.01); *A63B 2209/00* (2013.01); *A63B 2225/01* (2013.01); *A63B 2053/0408* (2013.01); *A63B 2053/0437* (2013.01)

(58) Field of Classification Search

CPC ..... A63B 2053/0437; A63B 2059/0011; A63B 2225/01; A63B 53/04; A63B 5/043

USPC ..... 473/327, 350, 349, 348, 345

See application file for complete search history.

(56) References Cited

U.S. PATENT DOCUMENTS

| | | | | |
|---|---|---|---|---|
| 5,092,599 | A * | 3/1992 | Okumoto et al. | 473/327 |
| 7,156,750 | B2 * | 1/2007 | Nishitani et al. | 473/329 |
| D630,278 | S * | 1/2011 | Albertsen et al. | D21/759 |
| 8,777,773 | B2 * | 7/2014 | Burnett et al. | 473/327 |
| 2003/0220154 | A1 * | 11/2003 | Anelli | 473/327 |
| 2010/0113176 | A1 * | 5/2010 | Boyd et al. | 473/291 |
| 2011/0294599 | A1 * | 12/2011 | Albertsen et al. | 473/349 |
| 2012/0142447 | A1 * | 6/2012 | Boyd et al. | 473/329 |
| 2014/0080627 | A1 * | 3/2014 | Bennett et al. | 473/332 |

* cited by examiner

*Primary Examiner* — Benjamin Layno

(74) *Attorney, Agent, or Firm* — Banner & Witcoff, Ltd.

(57) ABSTRACT

A golf club includes a shaft and a club head. The club head includes a ball striking face, a heel, a toe, a rear, and a crown. The crown may include a substantially horizontally-oriented forward crown region extending rearwardly from the ball striking face. The crown further may include a primary recessed feature located rearward of the forward crown region and extending from the heel to the toe of the club head. The recessed feature may have a floor and a front wall extending upward from the floor to the forward crown region. The crown may further include a substantially horizontally-oriented rearward crown region extending forwardly from the rear of the club head. The recessed feature may be located between the forward crown region and the rearward crown region. A back wall of the recessed feature may extend upward from the floor to the rearward crown region.

29 Claims, 7 Drawing Sheets

GOLF CLUB AND GOLF CLUB HEAD WITH A CROWN RECESSED FEATURE

RELATED APPLICATIONS

This application claims the benefit of priority of U.S. Provisional Application No. 61/654,065, filed May 31, 2012, the contents of which are hereby incorporated by reference in its entirety.

FIELD

Aspects of this invention relate generally to golf clubs and golf club heads, and, in particular, to golf clubs and golf club heads having a portion of the club head removed, thereby creating a void in the club head, in order to reduce weight associated with the club head and enhance performance.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Club designers are often looking for new ways to redistribute weight associated with a golf club and/or golf club head. For instance, club designers are often looking to distribute weight to provide more forgiveness in a club head, improved accuracy, and the like.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

At least some aspects of the disclosure relate to golf clubs and golf club heads having a void, channel, or other recessed feature formed in the crown of the golf club head.

In accordance with certain aspects, a golf club includes a shaft and a club head secured to a distal end of the shaft. The club head includes a ball striking face, a heel, a toe, a rear and a crown. The crown includes a substantially horizontally-oriented forward crown region extending rearwardly from the ball striking face. The crown may also include a substantially horizontally-oriented rearward crown region extending forwardly from the rear. The crown may further include a primary recessed feature located between the forward crown region and the rearward crown region and extending from the heel to the toe. The recessed feature has a floor and a front wall extending upward from the floor to the forward crown region. The recessed feature may also have a back wall extending upward from the floor to the rearward crown region.

According to even other aspects, a golf club head for a metal wood type club includes a ball striking face, a heel, a toe, a rear, and a crown. The crown includes a substantially horizontally-oriented forward crown region extending rearwardly from the ball striking face and a primary recessed feature located rearwardly of the forward crown region and extending from the heel to the toe of the club head. The recessed feature has a floor and a front wall extending upward from the floor to the forward crown region. At least a portion of the front wall of the primary recessed feature may have a rearward slant, such that at least a portion of the forward crown region forms an overhang that extends over at least a portion of the floor of the primary recessed feature. A front upper edge of the primary recessed feature, when viewed from above, may have a substantially chevron-shaped profile pointed rearwardly.

According to some aspects, a secondary recessed feature extending from the primary recessed feature toward the rear of the club head may be provided.

According to even other aspects, the rearward crown feature may be formed as two regions, with the secondary recessed feature located therebetween.

These and additional features and advantages disclosed here will be further understood from the following detailed disclosure of certain embodiments.

Figure 1B:
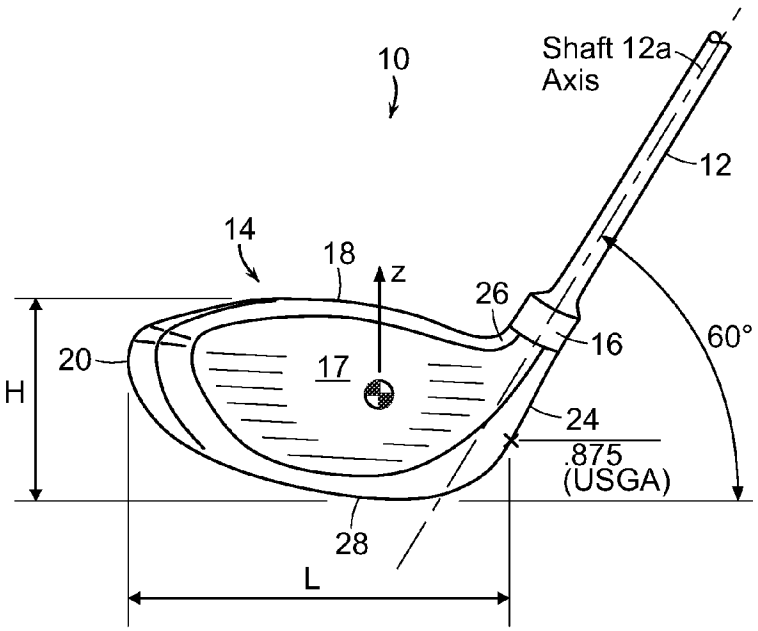
FIG. 1B is a schematic front view of a golf club illustrating certain parameters.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention.

The invention generally will be described as it relates to wood-type golf clubs. However, aspects of the invention may be used with any of several types of golf clubs, including hybrid type golf clubs, utility clubs, and the like and nothing in the specification or figures should be construed to limit the invention to use with the wood-type golf clubs described. Thus, a wide variety of overall club head constructions are possible without departing from this invention.

Further, if desired, some or all of the various individual parts of the club heads described below may be made from multiple pieces that are connected together (e.g., by welding, adhesives, or other fusing techniques; by mechanical connectors; etc.). The various parts (e.g., crown, sole, ball striking face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. The various parts of the club head may be formed of one or more composite materials. The club head also may be made by forging, casting, or other desired processes, including club head forming processes as are conventionally known and used in the art.

The various individual parts that make up a club head structure, if made from multiple pieces, may be engaged with one another and/or held together in any suitable or desired manner, including in conventional manners known and used in the art. For example, the various parts of the club head structure, such as the ball striking face, the crown, the sole, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure together.

The dimensions and/or other characteristics of a golf club head structure according to examples of this invention may vary significantly without departing from the invention, and the dimensions may be consistent with those commonly used in the art for similar club heads and clubs.

Figure 1A:
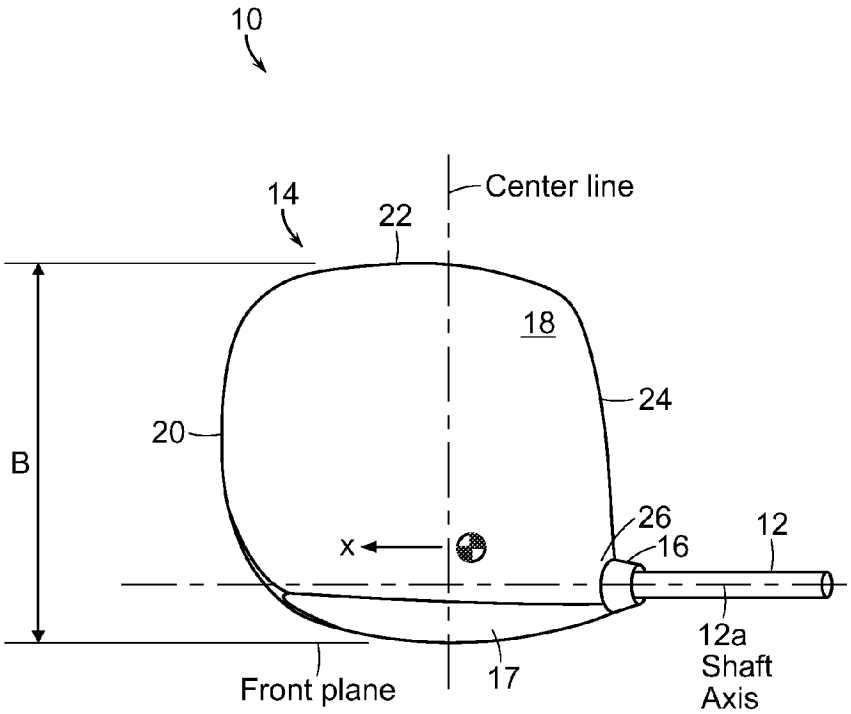
FIG. 1A is a schematic top plan view of a golf club illustrating certain parameters.

For purposes of this disclosure, and referring to FIGS. 1A and 1B, with a club head positioned at a 60-degree lie angle as defined by the USGA (see USGA, "Procedure for Measuring the Club Head Size of Wood Clubs"), the "centerline" of the club head may be considered to coincide with the indicator on the face squaring gauge when the face squaring gauge reads zero for clubs having a neutral face angle. The length (L) of the club head extends from the outermost point of the toe to the outermost point of the heel, as defined by the above-referenced USGA procedure. The breadth (B) of the club head extends from the outermost point of the face to the outermost point of the rear. Similar to the procedure for determining the outermost point of the toe (but now turned 90 degrees), the outermost points of the face and rear may be defined as the points of contact between the club head in the USGA 60-degree lie angle position with a vertical plate running parallel to the longitudinal axis of the shaft. The vertical plane associated with this measurement of the outermost point of the face may be referred to as the "front plane" of the club head. The height (H) of the club head extends from the uppermost point of the crown to the lowermost point of the sole, as defined by the above-referenced USGA procedure. The terms "above," "below," "upper," "lower," "top," "bottom," "front," "back," "rear," "side," "heel-side," "toe-side," etc. all may refer to views associated with the club head when it is positioned at this USGA 60-degree lie angle (also referred to as a "standard address position").

For purposes of this disclosure, "length" measurements or dimensions are taken parallel to the front plane of the club head and parallel to the ground. "Breadth" measurements or dimensions are taken parallel to the centerline of the club head and parallel to the ground. "Height" measurements or dimensions are taken parallel to a vertical plane when the club head is in its 60-degree lie angle position. Dimensions or measurements for a given region or surface are usually defined between transition points unless otherwise noted. A transition point is where a surface or region transitions from a generally (or substantially) vertical to a generally (or substantially) horizontal orientation or from a generally (or substantially) lengthwise to a generally (or substantially) breadthwise orientation. In the absence of a corner, a transition point may generally be defined as having a tangent at a 45 degree angle from the horizontal (or vertical) or a tangent at a 45 degree angle from the front plane (or centerline).

Still referring to FIGS. 1A and 1B, a golf club 10 having a golf club head 14 attached to a shaft 12 is shown schematically in order to illustrate certain general features. The golf club head 14 may be a driver, as shown. Club head 14 has a body that includes a hosel or socket 16 configured for receiving the shaft 12. The body of club head 14 may include a plurality of portions, regions or surfaces, such as a ball striking face 17, a crown 18, a toe 20, a rear 22, a heel 24, a hosel region 26 and a sole 28. For certain club heads, the body may include one or more cavities and/or may be substantially hollow.

Ball striking face 17 may be essentially flat or it may have a slight curvature or bow (for example, a "bulge" and/or a "roll"). Although the golf ball may contact ball striking face 17 at any spot on the face, the desired-point-of-contact of ball striking face 17 with the golf ball is typically approximately centered within ball striking face 17.

Crown 18, which is located on the upper or top side of club head 14, extends from ball striking face 17 back toward rear 22 of golf club head 14. When club head 14 is viewed from below, crown 18 cannot be seen.

Sole 28, which is located on the lower or ground side of club head 14 opposite to crown 18, extends from ball striking face 17 back toward rear 22. As with crown 18, sole 28 extends across the width of club head 14, from heel 24 to toe 20. When club head 14 is viewed from above, sole 28 cannot be seen.

Rear 22 is positioned opposite ball striking face 17, is located between crown 18 and sole 28, and extends from heel 24 to toe 20. When club head 14 is viewed from the front, rear 22 cannot be seen.

Heel 24 extends from ball striking face 17 to rear 22. When club head 14 is viewed from the toe-side, heel 24 cannot be seen.

Toe 20 is shown as extending from ball striking face 17 to rear 22 on the side of club head 14 opposite to heel 24. When club head 14 is viewed from the heel-side, toe 20 cannot be seen.

Socket 16 for attaching shaft 12 to club head 14 is located within hosel region 26. Hosel region 26 is shown as being located at the intersection of ball striking face 17, heel 24 and crown 18 and may encompass those portions of face 17, heel 24 and crown 18 that lie adjacent to socket 16. Generally, hosel region 26 includes surfaces that provide a transition from socket 16 to ball striking face 17, heel 24, crown 18 and/or sole 28.

Club head 14 may have a generally squared profile along a rear perimeter, when viewed from above, such that it could be described as a "square head." Although not a true square in geometric terms, the rear perimeter profile would be considered substantially square as compared to a more traditional, rounded, club head. It is further to be appreciated by persons of ordinary skill in the art that club head 14 may be provided with a more traditional rounded shape, when viewed from above. The phrase "round head" refers a club head 14 having a generally or substantially rounded profile. Similarly, a club head 14 provided with a generally triangular shaped rear perimeter profile may be referred to as having a "triangular head."

A longitudinal axis or shaft axis 12*a* extending longitudinally down the center of shaft 12 is shown in FIG. 1B. A grip or other handle element (not shown) may be positioned on shaft 12 to provide a golfer with a slip resistant surface with which to grasp golf club shaft 12. Shaft 12 of golf club 10 may be made of various materials that are conventionally known and used in the art and may be attached to club head 14 in any desired manner.

Figure 2A:
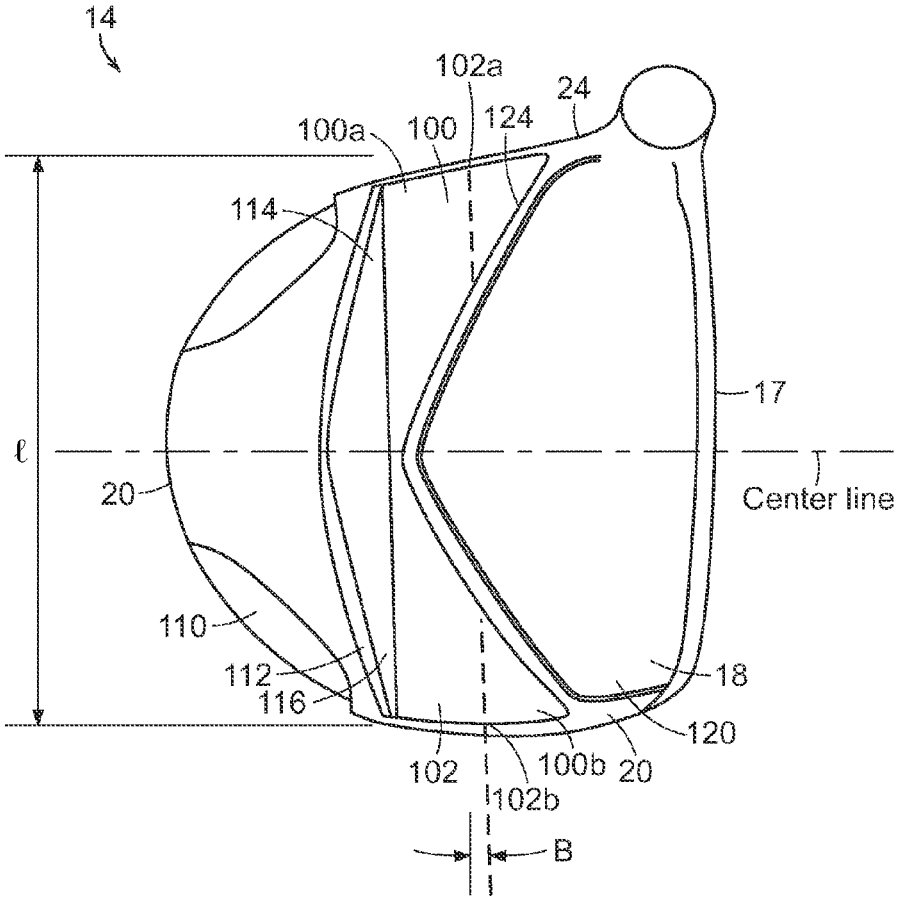
FIG. 2A is a top view of a golf club according to certain aspects.
Figure 2B:
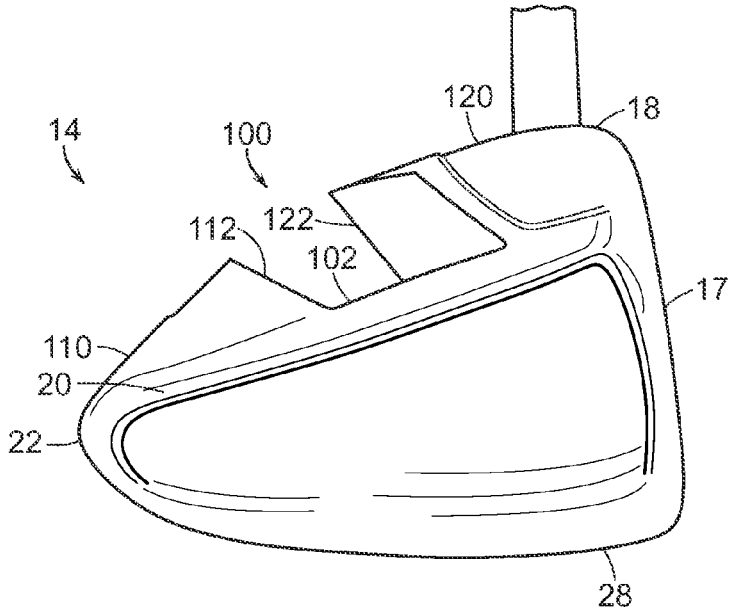
FIG. 2B is a heel-side view of the golf club of FIG. 2A.

An illustrative embodiment of a golf club according to aspects of the invention is shown in FIGS. 2A and 2B. As can generally be seen, the top or crown 18 of club head 14 may be provided with a channel or recessed feature 100, generally extending across crown 18 from heel 24 to toe 20. According to certain aspects, recessed feature 100 may essentially reduce the cross-sectional area of club head 14, when viewed from the heel-side, such that it is expected that air flowing over club head 14 from heel 24 toward toe 20 will encounter less resistance. Thus, it is expected that recessed feature 100 may result in reduced drag over the course of the golfer's downswing, higher club head speed at the moment of impact with the golf ball, and increased travel distance of the golf ball.

Referring then to FIGS. 2A-2B, crown 18 extends from ball striking face 17 to rear 22 and from heel 24 to toe 20. According to certain aspects, the channel or recessed feature 100 may be provided as a stepped-down portion formed in crown 18. Crown 18 includes a forward crown region 120 which is located adjacent ball striking face 17. The forward crown region 120 extends rearwardly from ball striking face 17. Further, the forward crown region 120 extends from hosel region 26 and/or heel 24 to toe 20. Generally, forward crown region 120 has a relatively horizontally-oriented surface. The surface may have a shallow or gentle convex curvature. Other surface configurations are also possible. Crown 18 also includes rearward crown region 110 which is located adjacent rear 22 of club head 14. Recessed feature 100 is formed between and separates forward crown region 120 and rearward crown region 110.

Figure 2C:
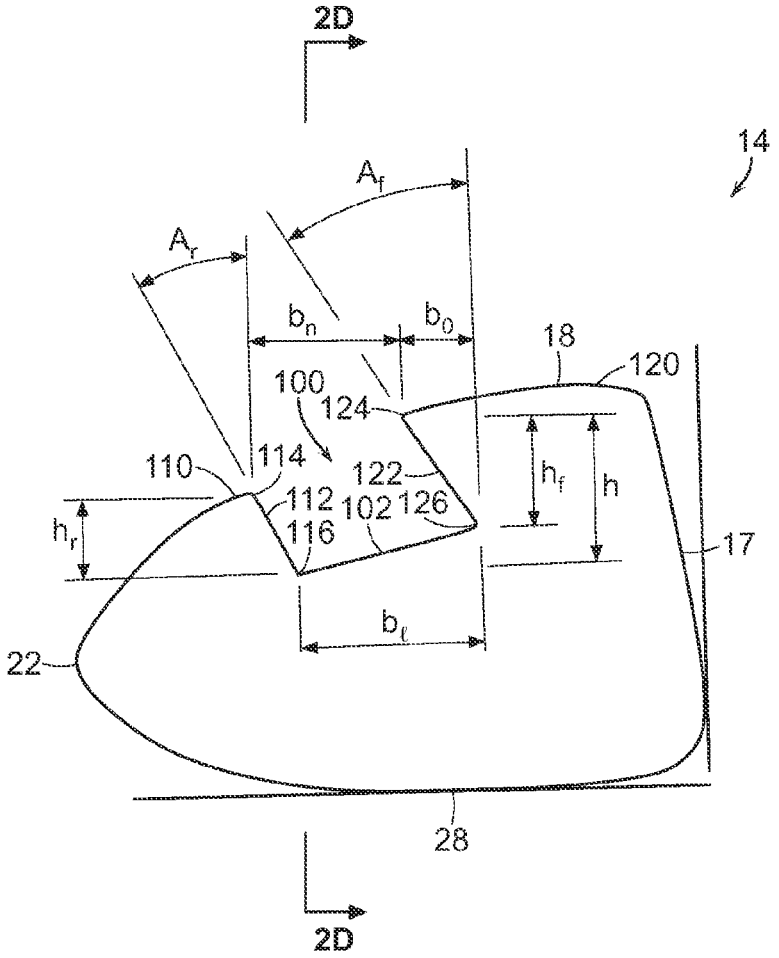
FIG. 2C is a schematic cross-section view of the golf club of FIG. 2A, taken along the centerline.

Referring to FIG. 2C, the recessed feature 100 includes a front wall 122 and a back wall 112 and a floor 102. Front wall 122 extends upward from floor 102 to forward crown region 120. Front wall 122 provides a transition region, wherein forward crown region 120 is stepped down or transitioned to floor 102 of recessed feature 100. Recessed feature 100 includes a front upper edge 124 where front wall 122 meets the crown surface of forward crown region 120. Recessed feature 100 also includes a front lower edge 126 where front wall 122 meets floor 102. Back wall 112 extends upward from floor 102 to rearward crown region 110. Back wall 112 also provides a transition region, wherein rearward crown region 110 is stepped down or transitioned to floor 102 of recessed feature 100. Recessed feature 100 includes a back upper edge 114 where back wall 112 meets the crown surface of rearward crown region 110.

The recessed feature 100 also includes a back lower edge 116 where back wall 112 meets floor 102. It is understood that the front wall 122 and/or back wall 112 could take other configurations including a curved configuration. The length of the walls 122,112 could also vary to adjust the depth or height of the recessed feature 100 as described in greater detail below.

Referring to FIG. 2A, recessed feature 100 has a length (l) extending from proximate a heel-side end 100*a* at heel 24 to proximate a toe-side end 100*b* at toe 20. In the particular embodiment of FIGS. 2A-2B, recessed feature 100 is visible from both the heel-side and from the toe-side. Recessed feature 100 may extend substantially parallel to the front plane. The recessed feature 100 could also be angled in either direction across the crown 18. A midpoint 102*a* may be established between front lower edge 126 and back lower edge 116 at the heel-side of recessed feature 100, and a midpoint 102*b* may be established between front lower edge 126 and back lower edge 116 at the toe-side of recessed feature 100. The orientation of recessed feature 100 may be determined by the angle (B) between a straight line running from midpoint 102*a* to midpoint 102*b* and the front plane. Thus, a recessed feature 100 that is substantially parallel to the front plane would have an angle B approximately equal to zero. According to certain aspects, recessed feature may have an orientation where angle B range from 0 degrees to 60 degrees. More typically, angle B may range from 0 degrees to 45 degrees, from 0 degrees to 30 degrees, or even from 0 degrees to 15 degrees.

Figure 2D:
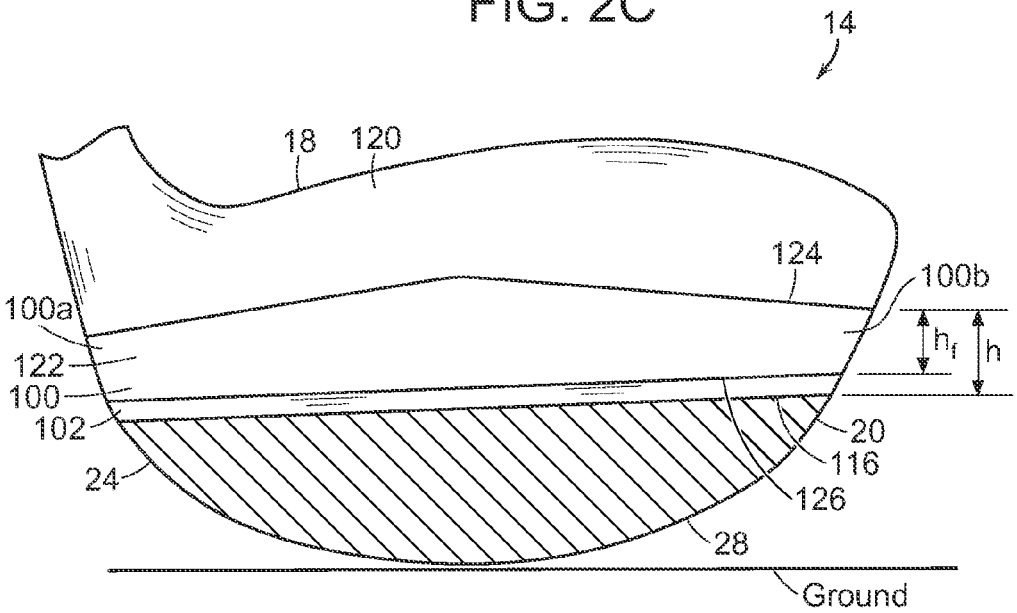
FIG. 2D is a schematic cross-section view of the golf club of FIG. 2A, taken along a perpendicular to the centerline through line 2D-2D of FIG. 2C.

Referring to FIGS. 2C and 2D, recessed feature 100 has a height (h) extending from its floor 102 up to crown 18. The height (h) of recessed feature 100 may be constant along the length (l) of recessed feature 100 or it may vary along its length. The varying height (h) of recessed feature 100 may be due to a curvature of crown 18 as crown 18 extends from heel 24 to toe 20 and/or it may be due to a change in elevation of floor 102. In some embodiments, for example referring to FIG. 2D, the height (h) of recessed feature 100 may be a relative minimum at one or both of the heel-side and toe-side of recessed feature 100 and a maximum in a central region. The maximum height of recessed feature 100 may be substantially aligned with the centerline of club head 14.

According to some embodiments, the height (h) of recessed feature 100 may be less along its back wall 112 (where it meets rearward crown region 110) as compared to its height (h) along its front wall 122 (where it meets forward crown region 120). The volume of the recessed feature 100 may increase towards the front wall 122.

According to certain aspects, the minimum height (h) of one or both of front wall 122 or back wall 112 may be 0.0 mm. As one example, the front wall 122 may have a height ($h_f$) that tapers to a 0.0 mm height at the toe-side 100*a* (and/or the heel side 100*b*) of recessed feature 100. The maximum forward height dimension ($h_f$) of recessed feature 100, i.e., the height as measured relative to forward crown region 120, may range from 2 mm to 30 mm, from 5 mm to 20 mm, or even from 10 mm to 20 mm. The back wall 112 may have a height ($h_r$) that also tapers to a 0.0 mm height at the toe-side (and/or the heel side) of recessed feature 100. The maximum rearward height dimension ($h_r$) of recessed feature 100, i.e., the height as measured relative to rearward crown region 110, may range from 1 mm to 20 mm, from 3 mm to 15 mm, or even from 5 mm to 10 mm.

Still referring to FIG. 2C, recessed feature 100 further has a breadth (b) extending from its front wall 122 to its back wall 112. A lower breadth dimension ($b_1$) may be measured from front lower edge 126 to back lower edge 116, i.e., measured along floor 102. The lower breadth ($b_l$) of recessed feature 100 may be constant when measured along its length from the heel 24 to the toe 20, or it may vary. Additionally, an upper breadth dimension ($b_u$) of recessed feature 100 may be measured at the crown-side opening of recessed feature 100, i.e., when measure between upper edges 124, 114. The upper breadth ($b_u$) of recessed feature 100 may be constant when measured along its length from the heel 24 to the toe 20, or it may vary.

The maximum breadth dimension ($b_l$) of recessed feature 100 as measured in the plane of floor 102 (i.e., a lower breadth dimension), may range from 10 mm to 50 mm, from 10 mm to 40 mm, or even from 20 mm to 40 mm. The maximum breadth dimension ($b_u$) of recessed feature 100 as measured from front upper edge 124 to back upper edge 114 (i.e., an upper breadth dimension), may range from 10 mm to 60 mm, from 10 mm to 50 mm, or even from 20 mm to 50 mm. Further, the lower maximum breadth dimension ($b_l$) may be greater than the maximum upper breadth dimension ($b_u$). Optionally, the lower maximum breadth dimension ($b_1$) may be less than the maximum upper breadth dimension ($b_u$), or may be equal to the maximum upper breadth dimension ($b_u$) of recessed feature 100.

Front wall 122 and/or back wall 112 may be vertically oriented. If both front wall 122 and/or back wall 112 are vertical and floor 102 is horizontal, then recessed feature 100 has a C-channel cross-section. Alternatively, front wall 122 and/or back wall 112 may be angled from the vertical. As shown in FIG. 2C, back wall 112 has a rearward slant, meaning that as it extends upward from floor 102 it also extends toward the rear 22 of club head 14. Front wall 122 also has a rearward slant in this embodiment. Optionally, front wall 122 and/or back wall 112 may have a forward slant, meaning that as the wall extends upward from floor 102 it also extends toward the front of club head 14. For purposes of this disclosure, a rearward slant is associated with a positive angle (A) from the vertical; a forward slant is associated with a negative angle (A) from the vertical. Recessed feature 100 may be formed with any combination of vertical, rearward slanted and/or forward slanted front and back walls 122, 112. Further, a portion of front wall 122 may be vertical while another portion may be slanted. Similarly, a portion of back wall 112 may be vertical while another portion may be slanted. It is further understood that the front wall 122 and back wall 112 may extend at different angles or be slanted differently from one another.

Thus, in general, front wall 122 may have an angle from the vertical that varies along the length of front wall 122. Angle ($A_f$) for front wall 122 may range from −45 degrees from a vertical plane (i.e., 0 degrees) to +60 degrees from a vertical plane. In other words, front wall 122 may be angled from a frontward slanted angle of −45 degrees to a rearward slanted angle of +60 degrees. More typically, front wall 122 is rearward slanted with an angle ($A_f$) that ranges from greater than 0 degrees to +45 degrees. Similarly, in general, back wall 112 may have an angle from the vertical that varies along the length of back wall 112. Angle ($A_r$) for back wall 112 may range from a frontward slanted −15 degrees through vertical (i.e., 0 degrees) to a rearward slanted +75 degrees. More typically, back wall 112 is rearward slanted with an angle ($A_r$) that ranges from greater than 0 degrees to +60 degrees.

As shown in the embodiment of FIGS. 2A-2C, front wall 122 has a rearward slant that varies along its length, with the slant increasing as front wall 122 extends from the heel 24 toward the centerline of club head 14 and then decreasing as front wall 122 extends from the centerline toward the toe 20. At the heel-side and toe-side of recessed feature 100, front wall 122 may be substantially vertical, whereas close to the centerline of club head 14, front wall 122 may have a rearward slant of from 30 degrees to 50 degrees. In this particular embodiment, back wall 112 has a rearward slant of from 30 degrees to 50 degrees that is constant along its length. If desired the back wall 112 could also have a rearward slant that varies along its length.

Even further, according to certain aspects, front wall 122 may extend linearly in its height dimension between lower edge 126 and upper edge 124. Alternatively, front wall 122 may have a slightly concave or slightly convex curvature along its height dimension. Similarly, back wall 112 may extend linearly, concavely or convexly between its lower and upper edges 116, 114. As shown in the embodiment of FIGS. 2A-2C, both front wall 122 and back wall extend linearly in their height dimensions.

According to some aspects, floor 102 of recessed feature 100 may be substantially planar. Further, floor 102 may be substantially horizontal. In some embodiments, floor 102 may be composed of more than one plane. For example, floor 102 may slant downward from heel-side edge toward the centerline of club head 14 and then slant upward from the centerline toward the toe-side edge. As another example, floor 102 may slant downward from front lower edge 126 to back lower edge 116. As even another example, floor 102 may initially slant downward as it extends from front lower edge 126 toward back lower edge 116, but then reverse its slant so that it slants upward (or even extends horizontally) where it meets back lower edge 116. In even other embodiments, floor 102 need not be planar, i.e., floor 102 may be provided with a slight curvature (either convex or concave).

Further, according to some embodiments, front upper edge 124 and/or back upper edge 114 may be formed as straight lines, when viewed from above, extending from the heel-side to the toe-side of club head 14. Alternatively, front upper edge 124 and/or back upper edge 114 may be formed as curved lines or as piecewise linear lines. As an example as shown in FIG. 2A, when viewed from above, front upper edge 124 may form a chevron pointing toward rear 22 of club head 14. Also as shown in FIG. 2A, when viewed from above, back upper edge 114 may curve concavely from heel-side to toe-side of recessed feature 100. Optionally, back upper edge 114 may also form a chevron pointing toward the rear 22. In some embodiments, the profiles of front and back upper edges 124, 114 may be substantially the same. Alternatively, one or both of the edges 124,114 may form a chevron pointing towards a desired backswing path for the golf club head.

Further, according to some embodiments, front lower edge 126 and/or back lower edge 116 may be formed as straight lines, when viewed from above, extending from the heel-side to the toe-side of club head 14. Thus, as shown in FIG. 2A, back lower edge 116 extends linearly from heel-side to toe-side of recessed feature 100. Alternatively, front lower edge 126 and/or back lower edge 116 may be formed as curved lines or as piecewise linear lines. As an example, when viewed from above, front lower edge 126 may form a chevron pointing toward rear 22 of club head 14. Similarly, back lower edge 116 may also form a chevron pointing toward the rear 22. In some embodiments, the profiles of front and back lower edges 126, 116 may be substantially the same.

When front wall 122 has a rearward slant, at least a portion of forward crown region 120 forms an overhang 125, which extends over (i.e., overhangs) recessed feature 100. This may be best seen in FIGS. 2B-2C. Overhang 125 may be defined as that portion of forward crown region 120 that is located above floor 102 of recessed feature 100. The greater the rearward slant of front wall 122, the greater the overhang 125.

According to some aspects, for example, as shown in FIGS. 2A-2C, the breadth dimension ($b_o$) of overhang 125 varies along the length of front wall 122. Alternatively, the breadth dimension ($b_o$) of overhang 125 may be constant along the length of front wall 122. The maximum breadth dimension ($b_o$) of overhang 125 may range from 0 mm to 60 mm, from 10 mm to 50 mm, or even from 20 mm to 50 mm. In some embodiments, the maximum breadth dimension ($b_o$) of overhang 125 may extend across more than 40%, more than 50%, more than 60%, more than 70% or even more than 80% of the upper breadth dimension ($b_o$) of recessed feature 100.

As shown in the embodiment of FIG. 2A, upper edge 124 of recessed feature 100 may have a substantially triangular or chevron-shaped profile, pointing toward the rear of club head 14, when viewed from above. The sides of the chevron-shaped profile may be slightly convex. In other embodiments, upper edge 124 (and thus also, overhang 125) may have a substantially triangular profile wherein the sides of the triangular profile are substantially straight or even slightly concave. Further, in the embodiment of FIG. 2A, the sides of the triangular profile of upper edge 124 are of substantially equal length. Because the sides of the triangular profile are of substantially equal length, the point of the chevron-shaped profile is approximately centered on a centerline of club head 14. For purposes of this disclosure, the point may be considered approximately centered on the centerline if it is located within plus or minus 10% of the length (L) of club head 14 from the centerline. In some embodiments, the point may even be located within plus or minus 5% of the length (L) of club head 14 from the centerline. In other embodiments, the sides of the triangular profile need not be of equal length and the point of the triangle may be shifted toward the heel 24 or toward the toe 20. Thus, as an example, the point may be located between plus or minus 10% and plus or minus 30% of the length (L) of club head 14 from the centerline.

In other embodiments, the breadth dimension ($b_o$) of overhang 125 may be constant or substantially constant along the length of recessed feature 100. In even other embodiments, overhang 125 may be convexly rounded, concavely rounded, or have other less regularly shaped profiles when viewed from above. Further, the breadth ($b_o$) of overhang 125 may be a maximum close to the centerline of club head 14, with local minimums at the heel-side and toe-side ends of recessed feature 100.

According to even other aspects, the heel-side end 100*a* of recessed feature 100 may be located in the rearward 75% of the total breadth (B) of club head 14. In other words, the heel-side end 100*a* of recessed feature 100 is not located in the forward 25% of club head 14. In other embodiments, the heel-side end 100*a* of recessed feature 100 may be limited to the middle 50% of the total breadth (B) of the club head 14. In other words, according to this aspect, if the total breadth (B) of club head 14 is divided into four quadrants, the heel-side end 100*a* of recessed feature 100 does not lie in the quadrant closest to ball striking face 17 nor does recessed feature 100 lie in the quadrant closest to rear 22.

Figure 3:
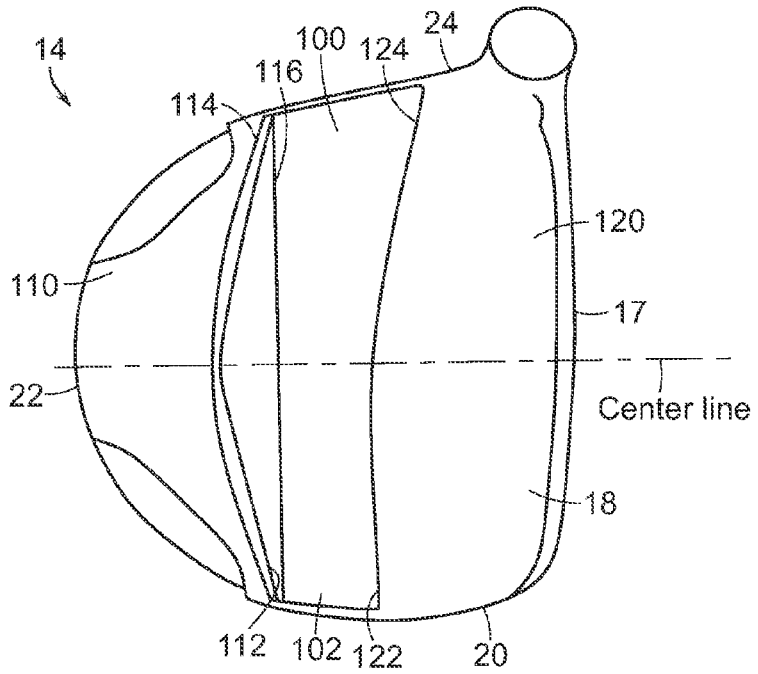
FIG. 3 is a top view of a golf club according to other aspects.
Figure 4:
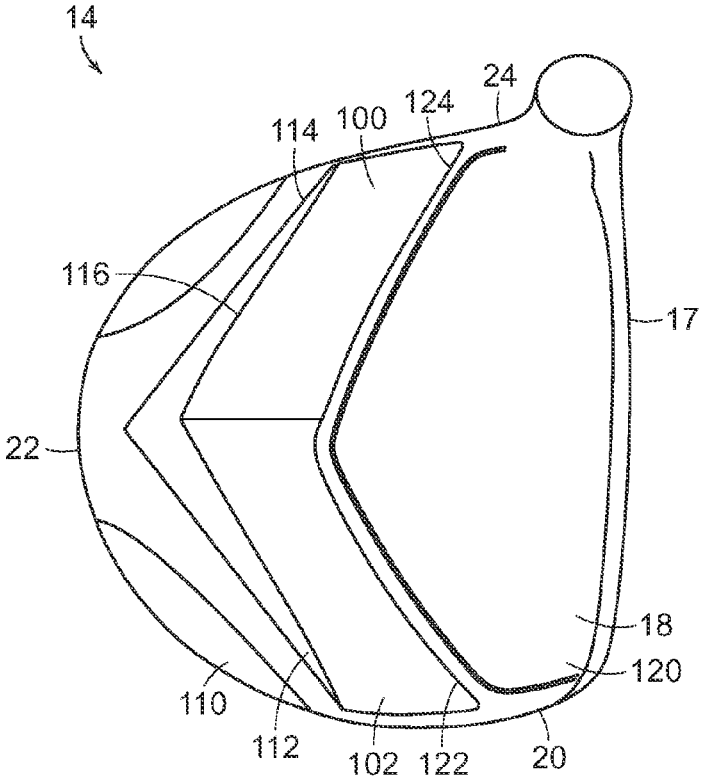
FIG. 4 is a top view of a golf club according to even other aspects.

FIGS. 3 and 4 show alternative embodiments of recessed feature 100. In FIG. 3, the rearward extent, i.e., its breadth dimension ($b_o$), of overhang 25 is less than in FIG. 2A. Further, in this particular embodiment, front upper edge 124 of recessed feature 100, when viewed from above, is oriented at a shallow angle to the front plane as it extends from the heel-side toward the centerline and is then oriented at almost zero degrees to the front plane as it extends from the centerline towards the toe-side of club head 14. In other words, the heel-side portion of upper edge 124 has a greater angle from the front plane than does the toe-side portion of upper edge 124. Thus, the profile of upper edge 124 is not symmetrical. In FIG. 4, back upper edge 114 and back lower edge 116 of recessed feature 100 both have a triangular or chevron shaped profile, when viewed from above.

Figure 5A:
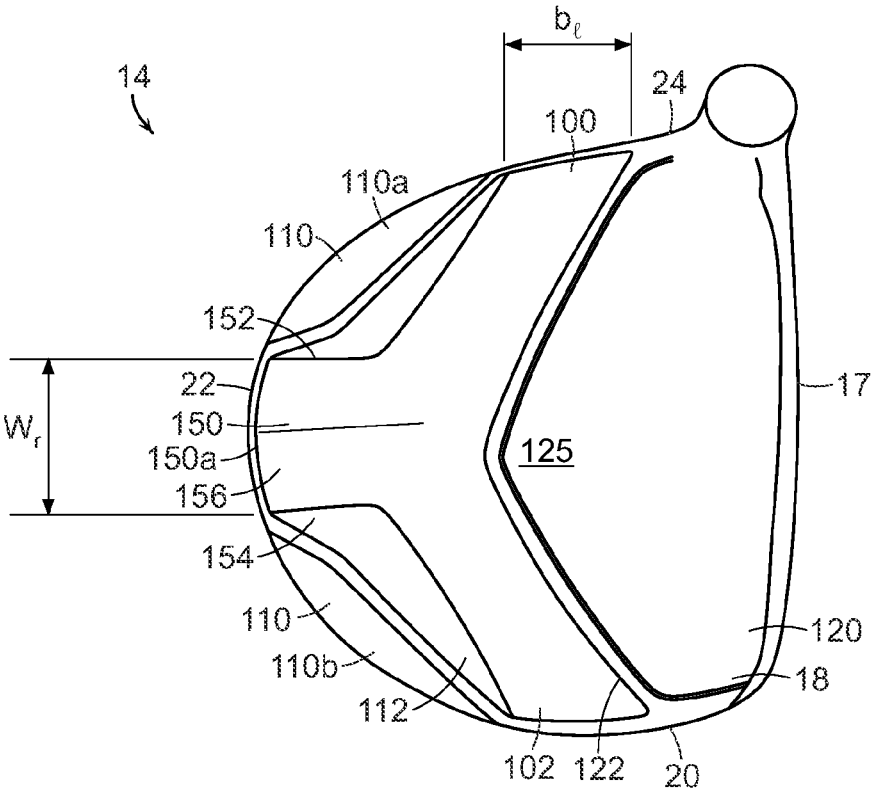
FIG. 5A is a top view of a golf club according to certain aspects.
Figure 5B:
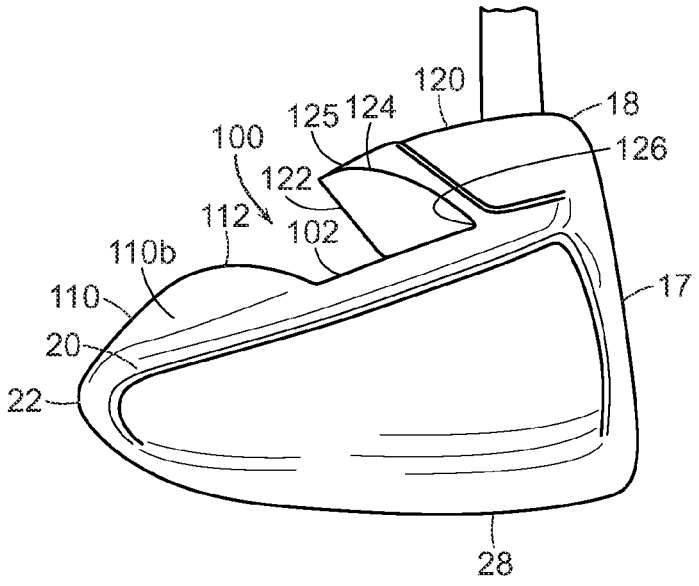
FIG. 5B is a heel-side view of the golf club of FIG. 5A.
Figure 5C:
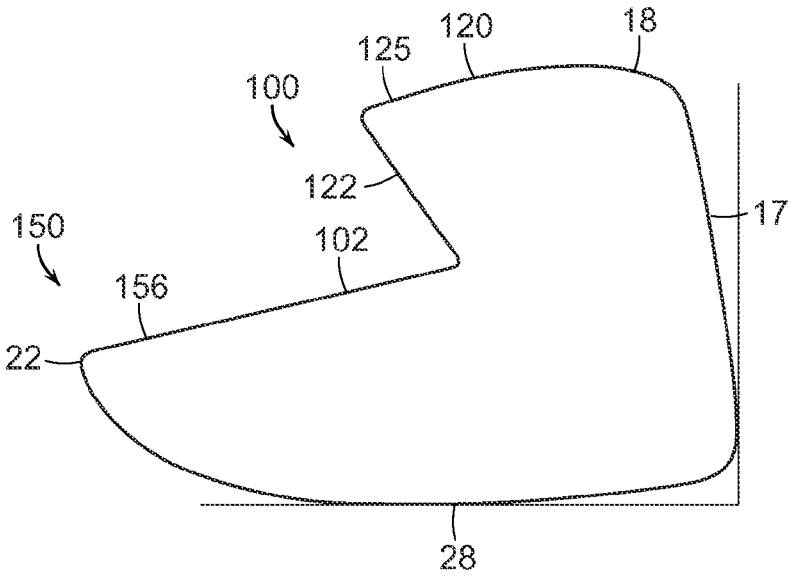
FIG. 5C is a cross-section view of the golf club of FIG. 5A, taken along the centerline.

FIGS. 5A-5C show another embodiment of club head 14 according to even other aspects. Notably rearward crown portion 110 is formed as two rearward crown portions 110*a* and 110*b*. Between the two rearward crown portions 110*a* and 110*b* is a secondary recessed feature 150. Secondary recessed feature 150 includes sidewalls 152 and 154 and a floor 156. Secondary recessed feature 150 extends between sidewalls 152, 154 in a generally front-to-rear direction. At its front end, secondary recessed feature 150 extends from and is joined to recessed feature 100. At its rear end 150*a*, secondary recessed feature 150 extends to rear 22 of club head 14.

Thus, according to certain aspects, a secondary recessed feature 150 may form a channel extending from (primary) recessed feature 100 toward the rear 22 of the club head. Secondary recessed feature 150 may be oriented substantially parallel to the centerline of club head 14. Additionally, secondary recessed feature 150 may be approximately centered on the centerline of club head 14. Optionally, however, secondary recessed feature 150 may be shifted toward the heel-side or toward the toe-side of club head 14. Even further, secondary recessed feature 150 may be oriented at an angle from the centerline of club head 14. As one example, secondary recessed feature 150 may be approximately centered on the centerline of club head 14 where it joins to primary recessed feature 100, but the rear end 150*a* of second recessed feature 150 may be shifted toward the toe-side of club head 14.

Sidewall 152 defines a heel-side wall of secondary recessed feature 150; sidewall 154 defines a toe-side wall of secondary recessed feature 150. Sidewalls 152, 154 may be vertically oriented or slanted. Floor 156 extends between sidewall 152 and sidewall 154. In this embodiment, floor 156 is joined to and forms a continuation of floor 102 of recessed feature 100. Floor 156 may be planar or curved (either concave or convex).

The width ($w_r$) of secondary recessed feature 150 at rear end 150*a* may range from 10 mm to 70 mm. More typically, the width ($w_r$) may range from 10 mm to 60 mm, from 10 mm to 50 mm, or even from 10 mm to 40 mm. Alternatively, the width ($w_r$) of secondary recessed feature 150 may be within 30% of the lower breadth ($b_l$) dimension of the heel-side end of recessed feature 100. In other words, if the lower breadth dimension ($b_l$) of the heel-side end of recessed feature 100 is 20 mm, then the width ($w_r$) of secondary recessed feature 150 may range from 20 mm±6 mm, i.e., from 14 mm to 26 mm. The width dimension of secondary recessed feature 150 may optionally be within 20%, or even within 10%, of the lower breadth dimension ($b_1$) of the heel-side end of recessed feature 100.

As best shown in FIG. 5B, at the toe-side of club head 14, front wall 122 of recessed feature 100 may be concavely curved in the height dimension, i.e., when viewed from a side of club head 14, front wall 122 is concavely curved as it extends from lower front edge 124 to upper front edge 126. However, as best shown in FIG. 5C, at the centerline of club head 14, front wall 122 forms a straight line in the height dimension, i.e., when viewed from a side of club head 14, front wall 122 has a linear profile as it extends from lower front edge 124 to upper front edge 126. Thus, it is apparent that the contour of front wall 122 changes from a concavely curved profile at the toe-side of recessed feature 100 to linear profile at the centerline of club head 14.

Further, as best shown in FIG. 5B, at the toe-side of club head 14, floor 102 of recessed feature 100 is angled upward relative to the horizontal ground surface. As best shown in FIG. 5C, at the centerline of club head 14, floor 102 of recessed feature 100 is still angled upward, but at a shallower angle, relative to the horizontal ground surface. Even further, at the centerline of club head 14, floor 156 of secondary recessed feature 150 is oriented at substantially the same angle as floor 102 such that floor 102 and floor 156 are smoothly continuous.

Figure 6:
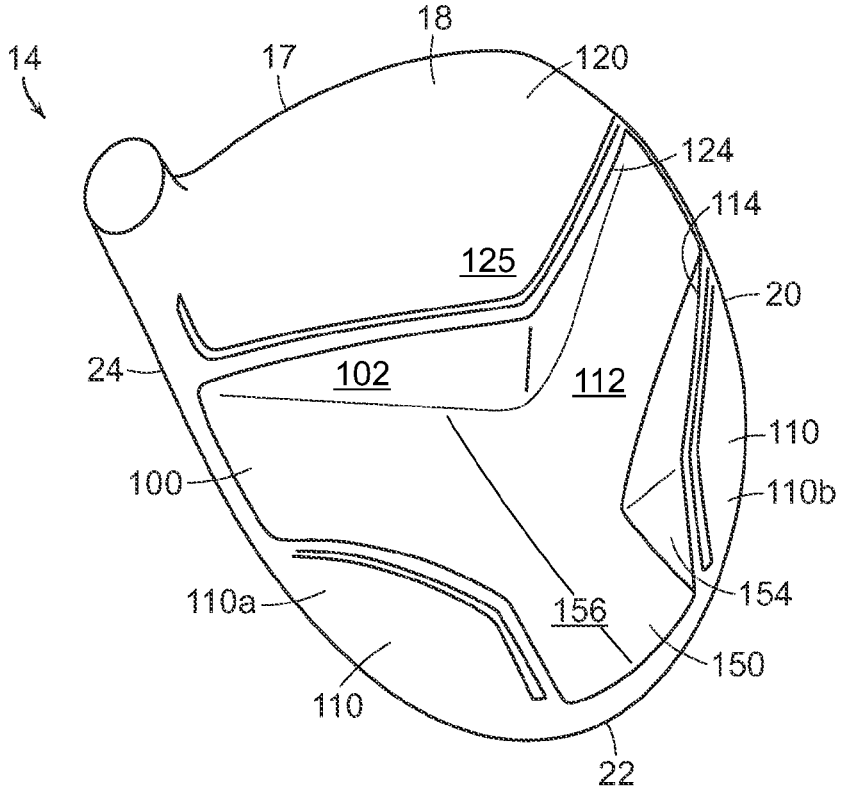
FIG. 6 is a top view of a golf club according to further aspects.
Figure 7:
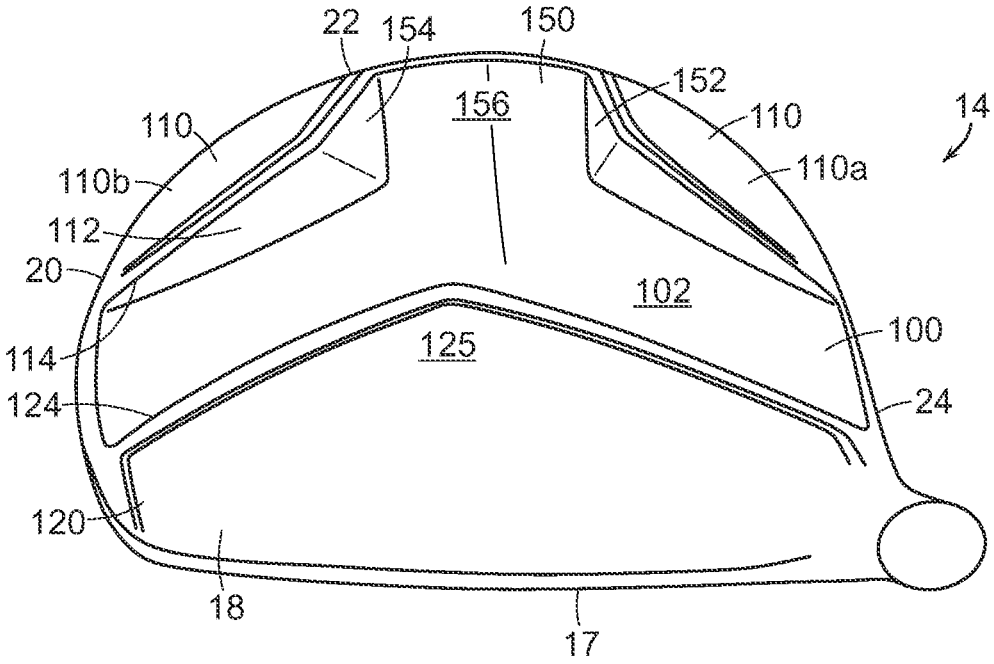
FIG. 7 is a top view of a golf club according to even further aspects.

FIGS. 6 and 7 illustrate recessed features 100 and 150 in club heads 14 of various shapes and sizes.

Forward crown region 120 provides a smooth surface for air encountering ball striking face 17 to flow up and over, particularly when ball striking face 17 is leading the swing. Recessed feature 100 allows forward crown region 120 to be at a different height than rearward crown region 110. Thus, advantageously, the crown surface of forward crown region 120 of club head 14 may be designed independently from the crown surface of rearward crown region 110. This may allow for a greater height of ball striking face 17, while allowing a cross-sectional area of heel 24 to be reduced to provide greater aerodynamic streamlining for air flowing over heel 24. Similar club head features described above are generally applicable to the features of the club heads shown in FIGS. 6 and 7.

Thus, according to certain aspects, recessed feature 100 may have a cross-sectional area ranging from 1 $cm^2$ to 3 $cm^2$.

According to certain aspects, the length and/or the breadth of the club head may be greater than 11.0 cm. For example, the club head breadth (B) may be greater than or equal to approximately 11.5 cm, or even greater than or equal to approximately 12.0 cm. Similarly, by way of one example, the club head length (L) may be greater than or equal to approximately 11.5 cm, or even greater than or equal to approximately 12.0 cm.

It is expected that a club head having a recessed feature 100, relative to a club head having the same gross volume without a recessed feature, will provide a more streamlined club head with improved moment-of-inertia (MOI) characteristics. For example, it is expected that the moment-of-inertia (Izz) around a vertical axis associated with the club head's center-of-gravity may be greater than 3100 g-$cm^2$, greater than 3200 g-$cm^2$, or even greater than 3300 g-$cm^2$ for square-head type club heads. Further, it is expected that the moment-of-inertia (Ixx) around a horizontal axis associated with the club head's center-of-gravity may be greater than 5250 g-$cm^2$, greater than 5350 g-$cm^2$, or even greater than 5450 g-$cm^2$ for square-head type club heads. The vertical (z) axis and the horizontal (x) axis are defined with the club head in the 60° lie angle position (see FIGS. 1A and 1B).

Additionally, it is expected that recessed feature 100 may result in the height of the center of gravity (CG) of club head 14 being less than or equal to approximately 2.0 cm, less than or equal to approximately 1.75 cm, or even less than or equal to approximately 1.5 cm.

Thus it can be seen, given the benefit of this disclosure, that recessed feature 100 of the embodiments described herein essentially separates or decouples the curvature of the surface of forward crown region 120 from the curvature of the surface of rearward crown region 110. In other words, to a certain extent, the curvature characteristics of the surface of forward crown region 120 may be developed without consideration of the curvature characteristics being developed for the surface of rearward crown region 110. This offers the club head designer greater flexibility when shaping the surface of crown 18 and incorporating or developing aerodynamic features.

Secondary recessed feature 150 may provide an additional channel or outlet for air traveling within recessed feature 100 to exit. This may be most effective when the heel of the golf club 10 is leading the swing during the downward swing of the golf club. Further, secondary recessed feature 150 may provide a channel for air traveling over the forward crown region 120 from ball striking face 17. This may be most effective when the ball striking face 17 is leading the swing.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a metal wood type club, the club head comprising:

a ball striking face, a heel, a toe, a rear, and a crown, the crown including:

a substantially horizontally-oriented forward crown region extending rearwardly from the ball striking face;

a substantially horizontally-oriented rearward crown region extending forwardly from the rear; and a primary recessed feature located between the forward crown region and the rearward crown region and extending from the heel to the toe, the recessed feature having a floor, a front wall extending upward from the floor to the forward crown region, and a back wall extending upward from the floor to the rearward crown region, wherein at least a portion of the front wall has a rearward slant, such that at least a portion of the forward crown region forms an overhang that extends over at least a portion of the floor of the primary recessed feature, and wherein a maximum breadth dimension of the overhang ranges from 50% to 80% of a maximum lower breadth dimension of the primary recessed feature.

2. The golf club head of claim 1, wherein a maximum breadth dimension of the overhang ranges from 10 mm to 50 mm.

3. The golf club head according to claim 1, wherein a maximum lower breadth dimension of the primary recessed feature ranges from 10 mm to 50 mm.

4. The golf club head according to claim 1, wherein a maximum upper breadth dimension of the primary recessed feature ranges from 10 mm to 70 mm.

5. The golf club head according to claim 1, wherein at least a portion of the back wall has a rearward slant.

6. The golf club head according to claim 1, wherein a maximum height dimension of the front wall ranges from 10 mm to 60 mm.

7. The golf club head according to claim 1, wherein a maximum height dimension of the back wall ranges from 5 mm to 50 mm.

8. The golf club head according to claim 1, further comprising:

a secondary recessed feature extending from the primary recessed feature toward the rear of the club head.

9. The golf club head of claim 8, wherein the rearward crown region is formed as two regions.

10. The golf club head according to claim 1, wherein a front upper edge of the primary recessed feature, when viewed from above, has a rearward-facing convex profile.

11. The golf club head according to claim 1, wherein a front upper edge of the primary recessed feature, when viewed from above, has a substantially chevron-shaped profile pointed rearwardly.

12. The golf club head of claim 11, wherein the chevron-shaped profile is approximately centered on a centerline of the club head.

13. The golf club head according to claim 1, wherein a front lower edge of the primary recessed feature, when viewed from above, has a linear profile.

14. The golf club head according to claim 1, wherein a front lower edge of the primary recessed feature, when viewed from above, has a chevron-shaped profile pointed rearwardly.

15. The golf club head according to claim 1, wherein a back lower edge of the primary recessed feature, when viewed from above, has a linear profile.

16. The golf club head according to claim 1, wherein a back lower edge of the primary recessed feature, when viewed from above, has a chevron-shaped profile pointed rearwardly.

17. The golf club head according to claim 1, wherein a back upper edge of the primary recessed feature, when viewed from above, has a forward-facing concave profile.

18. The golf club head according to claim 1, wherein a back upper edge of the primary recessed feature, when viewed from above, has a chevron-shaped profile pointed rearwardly.

19. The golf club head according to claim 1, wherein the heel-side end of the primary recessed feature is located within the middle 50% of the total breadth of the club head.

20. The golf club head according to claim 1, wherein the club head has a round head profile, when viewed from above.

21. A golf club comprising:

a shaft; and a golf club head attached to the shaft, the golf club head including:

a ball striking face, a heel, a toe, a rear, and a crown, the crown including:

a substantially horizontally-oriented forward crown region extending rearwardly from the ball striking face;

a substantially horizontally-oriented rearward crown region extending forwardly from the rear;

a primary recessed feature located between the forward crown region and the rearward crown region and extending from the heel to the toe, the recessed feature having a floor, a front wall extending upward from the floor to the forward crown region, and a back wall extending upward from the floor to the rearward crown region; and a secondary recessed feature extending from the primary recessed feature toward the rear of the club head.

22. The golf club according to claim 21, wherein at least a portion of the front wall has a rearward slant, such that at least a portion of the forward crown region forms an overhang that extends over at least a portion of the floor of the primary recessed feature.

23. The golf club according to claim 22, wherein a maximum breadth dimension of the overhang ranges from 50% to 80% of a maximum lower breadth dimension of the primary recessed feature.

24. A golf club head for a metal wood type club, the club head comprising:

a ball striking face, a heel, a toe, a rear, and a crown, the crown including:

a substantially horizontally-oriented forward crown region extending rearwardly from the ball striking face; and a primary recessed feature located rearwardly of the forward crown region and extending from the heel to the toe, the recessed feature having a floor and a front wall extending upward from the floor to the forward crown region, wherein at least a portion of the front wall of the primary recessed feature has a rearward slant, such that at least a portion of the forward crown region forms an overhang that extends over at least a portion of the floor of the primary recessed feature, and wherein a front upper edge of the primary recessed feature, when viewed from above, has a substantially chevron-shaped profile pointed rearwardly.

25. The golf club head of claim 24, wherein a maximum breadth dimension of the overhang ranges from 10 mm to 50 mm.

26. The golf club head according to claim 24, wherein a maximum height dimension of the front wall ranges from 10 mm to 60 mm.

27. The golf club head according to claim 24, wherein, at least a portion of the front wall has a concave curvature, when viewed from a side.

28. The golf club head according to claim 24, wherein, at least a portion of the front wall has a linear profile, when viewed from a side.

29. The golf club head according to claim 24, wherein the chevron-shaped profile is approximately centered on a centerline of the club head.

* * * * *